US007530734B2

(12) United States Patent
Liu et al.

(10) Patent No.: US 7,530,734 B2
(45) Date of Patent: May 12, 2009

(54) PERFORMANCE TESTING APPARATUS FOR HEAT PIPES

(75) Inventors: Tay-Jian Liu, Tu Cheng (TW); Chih-Hsien Sun, Tu Cheng (TW); Chao-Nien Tung, Tu Cheng (TW); Chuen-Shu Hou, Tu Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 176 days.

(21) Appl. No.: 11/308,548

(22) Filed: Apr. 5, 2006

(65) Prior Publication Data

US 2007/0107870 A1 May 17, 2007

(30) Foreign Application Priority Data

Nov. 17, 2005 (CN) ..... 2005 1 0101520

(51) Int. Cl.
*G01K 1/16* (2006.01)
*G01K 25/00* (2006.01)

(52) U.S. Cl. ..... 374/44; 374/57; 374/147; 374/208; 374/5; 374/29; 374/137

(58) Field of Classification Search ..... 374/4, 374/5, 29–32, 39, 43–44, 57, 137, 147, 152, 374/208, 179, 141
See application file for complete search history.

(56) References Cited

U.S. PATENT DOCUMENTS

| | | | | |
|---|---|---|---|---|
| 3,453,865 | A * | 7/1969 | Reiter et al. | 374/33 |
| 4,067,237 | A * | 1/1978 | Arcella | 73/204.23 |
| 4,595,297 | A * | 6/1986 | Liu et al. | 374/29 |
| 4,963,194 | A * | 10/1990 | Mele | 136/221 |
| 5,248,198 | A * | 9/1993 | Droege | 374/7 |
| 5,355,683 | A * | 10/1994 | Taylor | 62/51.1 |
| 5,707,152 | A * | 1/1998 | Krywitsky | 374/208 |
| 5,980,102 | A * | 11/1999 | Stulen et al. | 374/45 |
| 7,147,368 | B2 * | 12/2006 | Chien | 374/147 |
| 2001/0053172 | A1 * | 12/2001 | Sakowsky et al. | 374/147 |

FOREIGN PATENT DOCUMENTS

TW M279851 11/2005

* cited by examiner

*Primary Examiner*—Gail Verbitsky
(74) *Attorney, Agent, or Firm*—Frank R. Niranjan

(57) ABSTRACT

A performance testing apparatus for a heat pipe includes an immovable portion having a cooling structure defined therein for cooling a heat pipe needing to be tested. A movable portion is capable of moving relative to the immovable portion. A receiving structure is defined between the immovable portion and the movable portion for receiving the heat pipe therein. At least a temperature sensor is attached to at least one of the immovable portion and the movable portion. The least a temperature sensor has a detecting section exposed in the receiving structure for thermally contacting the heat pipe in the receiving structure to detect a temperature of the heat pipe.

6 Claims, 11 Drawing Sheets

PERFORMANCE TESTING APPARATUS FOR HEAT PIPES

FIELD OF THE INVENTION

The present invention relates generally to a testing apparatus, and more particularly to a performance testing apparatus for heat pipes.

DESCRIPTION OF RELATED ART

It is well known that a heat pipe is generally a vacuum-sealed pipe. A porous wick structure is provided on an inner face of the pipe, and at least a phase changeable working media employed to carry heat is filled in the pipe. Generally, according to positions from which heat is input or output, the heat pipe is defined with three sections, which are evaporating section, condensing section and adiabatic section between the evaporating section and the condensing section.

In use, the heat pipe transfers heat from one place to another place mainly by virtue of phase change of the working media taking place therein. Generally, the working media is liquid such as alcohol, water and so on. When the working media in the evaporating section of the heat pipe is heated up, it vapors, and pressure difference is thus produced between the evaporating section and the condensing section in the heat pipe. Resultant vapor with high enthalpy rushes to the condensing section and condenses there. Then the condensed liquid reflows to the evaporating section along the wick structure. This evaporating/condensing cycle repeats in the heat pipe; consequently, heat is transferred from the evaporating section to the condensing section continually. Due to the continual phase change of the working media, the evaporating section is kept at or near the same temperature as the condensing section of the heat pipe. The heat pipe is used widely owing to its great heat-transfer capability.

In order to ensure the heat pipe working effectively, the heat pipe is generally required to be tested before sent for application. The maximum heat transfer capacity (Qmax) and the temperature difference ($\Delta T$) between the evaporating section and the condensing section are two important parameters for evaluating performance of the heat pipe. When a predetermined quantity of heat is input into the heat pipe through the evaporating section thereof, thermal resistance (Rth) of the heat pipe can be obtained from $\Delta T$, and the performance of the heat pipe can be evaluated. The relationship between these parameters Qmax, Rth and $\Delta T$ is $Rth=\Delta T/Qmax$. When the input quantity of heat exceeds the maximum heat transfer capacity (Qmax), the heat cannot be timely transferred from the evaporating section to the condensing section, whereby temperature of the evaporating section is rapidly increased.

Conventionally, a method for testing performance of a heat pipe is first to insert the evaporating section of the heat pipe into liquid at constant temperature; after a predetermined period of time and temperature of the heat pipe becomes stable, then a temperature sensor such as a thermocouple, a resistance thermometer detector (RTD) and so on is used to measure $\Delta T$ between the liquid and the condensing section of the heat pipe to evaluate the performance of the heat pipe. However, Rth and Qmax can not be obtained from this test, and the performance of the heat pipe can be reflected exactly from this test.

Referring to FIG. 7, a conventional performance testing apparatus for heat pipes is shown. The apparatus has a resistance wire 1 coiling round an evaporating section 2*a* of a heat pipe 2, and a water cooling sleeve 3 functioning as a heat sink and enclosing a condensing section 2*b* of the heat pipe 2. In use, a power controlled by a voltmeter and an ammeter is given to the resistance wire 1, whereby the resistance wire 1 produces heat to the evaporating section 2*a* of the heat pipe 2. Simultaneously, by controlling flow rate and temperature of cooling liquid entering the cooling sleeve 3, the heat input at the evaporating section 2*a* can be removed from the heat pipe 2 by the cooling liquid at the condensing section 2*b*, whereby a stable operating temperature of adiabatic section 2*c* of the heat pipe 2 is obtained. Therefore, Qmax of the heat pipe 2 and $\Delta T$ between the evaporating section 2*a* and the condensing section 2*b* can be obtained by temperature sensors 4 at different positions of the heat pipe 2.

However, in the test, the conventional testing apparatus has drawbacks as follows: a) it being difficult to accurately determine lengths of the evaporating section 2*a* and the condensing section 2*b* which are important factors in determining the performance of the heat pipe 2; b) heat transference and temperature measurement being prone to be impacted by environmental conditions; c) it being difficult to realize intimate contact between the heat pipe and the heat source and between the heat pipe and the heat sink, which results in unsteady performance test results of the heat pipe. Furthermore, due to fussy and laborious assembly and disassembly in the test, the testing apparatus can be only applied in laboratory, not be competent for testing demand in mass production of the heat pipes.

In mass production of the heat pipes, large number of performance testing apparatuses are needed, and the apparatus are used frequently over a long period of time; thus, the apparatuses not only are demanded to have good testing accuracy by themselves, but also are required to be easily and accurately in assembly with the heat pipes to be tested. The testing apparatus impacts the yield and cost of the heat pipes directly; thus, testing accuracy, facility, celerity, consistency, reproducibility and reliability need to be considered for the testing apparatus in test. Therefore, the conventional testing apparatus needs to be improved in order to meet the above testing demands during mass production of the heat pipes.

What is needed, therefore, is a performance testing apparatus for heat pipes suitable for use in mass production of the heat pipes.

SUMMARY OF INVENTION

A performance testing apparatus for a heat pipe in accordance with a preferred embodiment of the present invention comprises an immovable portion having a cooling structure defined therein for removing heat from a condensing section of a heat pipe needing to be tested. A movable portion is capable of moving relative to the immovable portion. A receiving structure is defined between the immovable portion and the movable portion for receiving the condensing section of the heat pipe therein. At least a temperature sensor is attached to at least one of the immovable portion and the movable portion. The at least a temperature sensor has a portion thereof exposed in the receiving structure for thermally contacting the condensing section of the heat pipe in the receiving structure to detect a temperature of the heat pipe. The movable portion is driven by a driving device such as a step motor to move toward or away from the immovable portion. A spring coil is compressed to exert a push force to the at least a temperature sensor to have an intimate contact with the condensing section of the heat pipe.

Other advantages and novel features will become more apparent from the following detailed description of preferred embodiments when taken in conjunction with the accompanying drawings, in which:

DETAILED DESCRIPTION

Figure 1:
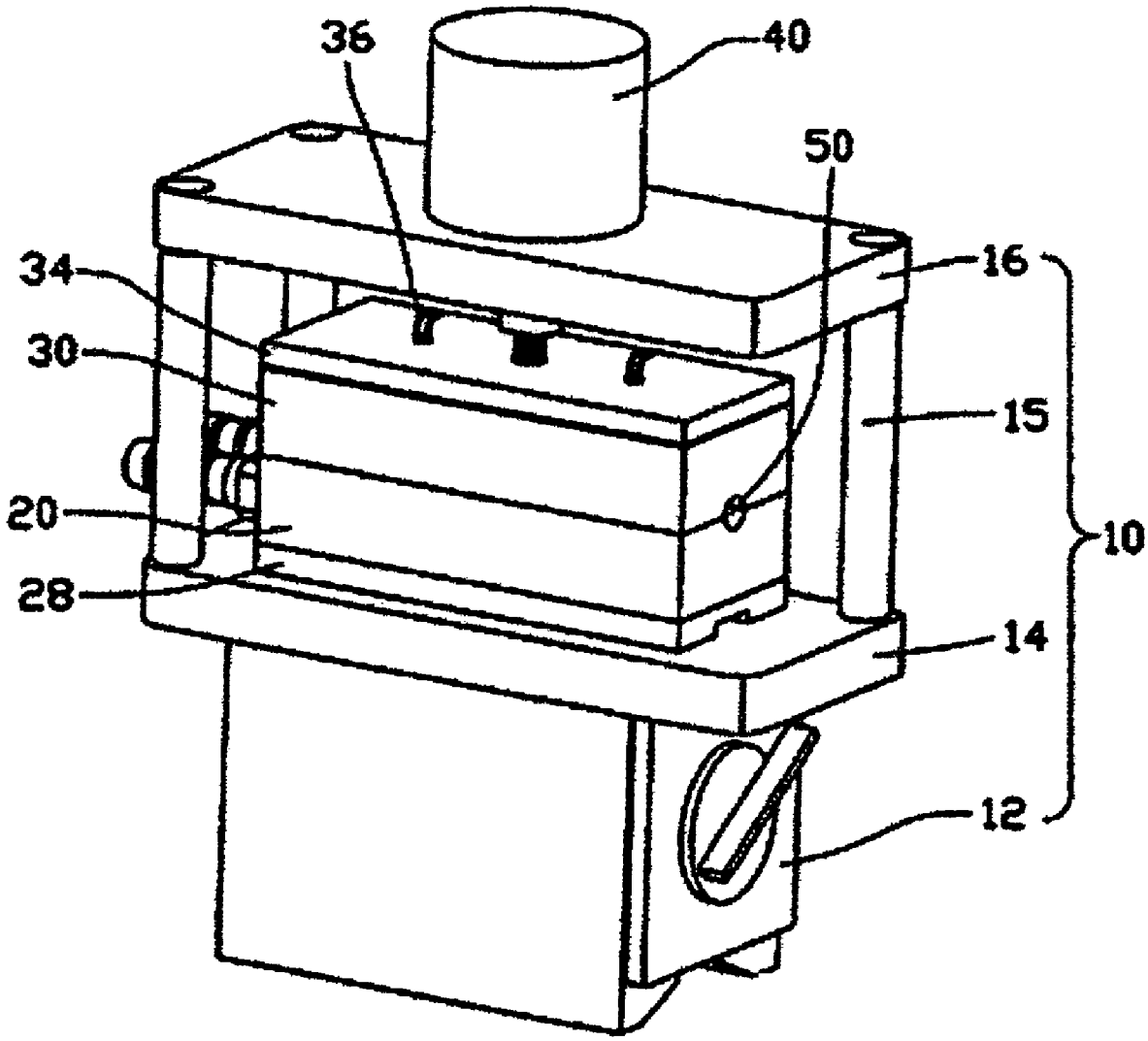
FIG. 1 is an assembled view of a performance testing apparatus for heat pipes in accordance with a preferred embodiment of the present invention.
Figure 2:
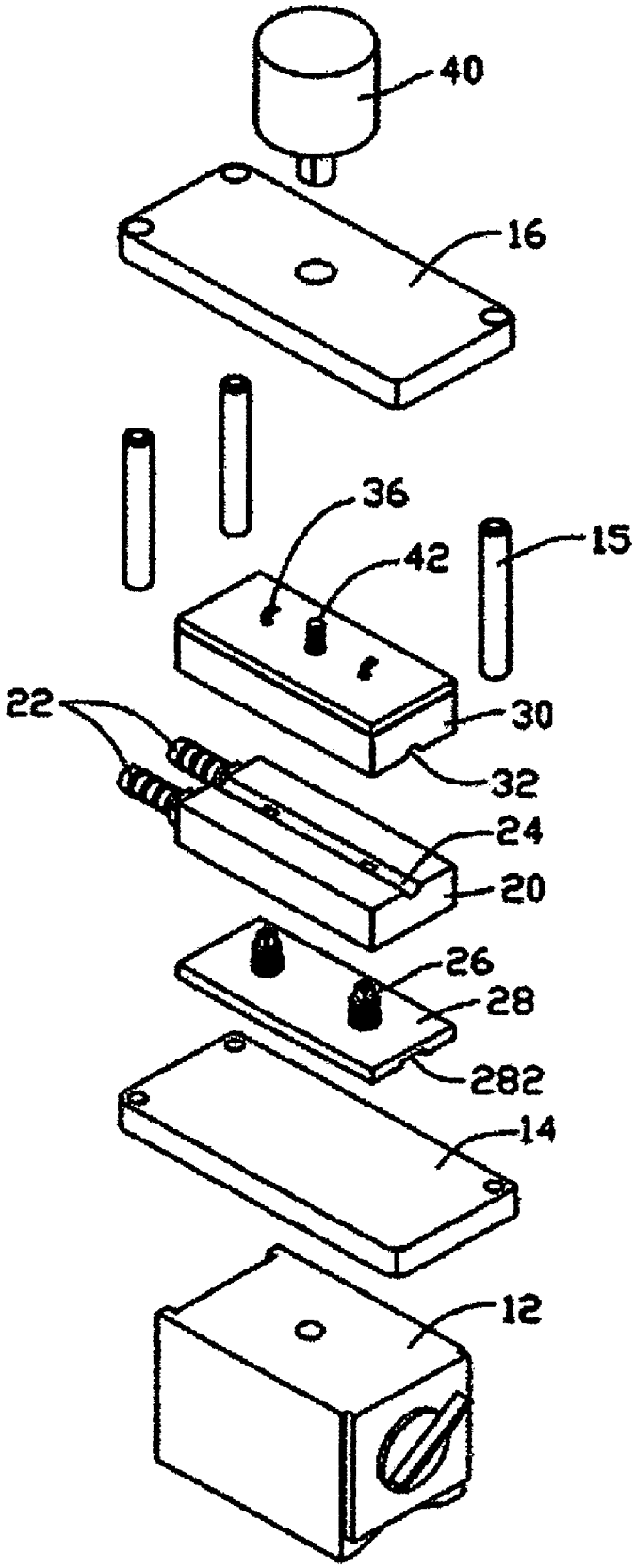
FIG. 2 is an exploded, isometric view of the testing apparatus of FIG. 1.

Referring to FIGS. 1 and 2, a performance testing apparatus for heat pipes comprises an immovable portion 20 and a movable portion 30 movably mounted the immovable portion 20.

The immovable portion 20 has a good heat conductivity and is retained at a platform of a supporting member such as a testing table and so on. Cooling passageways (not shown) are defined in an inner portion of the immovable portion 20, for coolant flowing therein. An inlet and an outlet 22 communicate the passageways with a constant temperature coolant circulating device (not shown); therefore, the passageways, inlet 22, outlet 22 and the coolant circulating device corporately define a cooling system for the coolant circulating therein to remove heat from the heat pipe in test. The immovable portion 20 has a cooling groove 24 defined in a top face thereof, for receiving a condensing section of the heat pipe to be tested therein. Two temperature sensors 26 are inserted into the immovable portion 20 from a bottom thereof to reach a position wherein detecting portions of the sensors 26 are in the cooling groove 24 and capable of automatically contacting the heat pipe to detect a temperature of the condensing section of the heat pipe. In order to prevent heat in the immovable portion 20 from spreading to the supporting member, an insulating plate is disposed between the immovable portion 20 and the supporting member.

The movable portion 30, corresponding to the cooling groove 24 of the immovable portion 20, has a positioning groove 32 defined therein, whereby a testing channel 50 is corporately defined by the cooling groove 24 and the positioning groove 32 when the movable portion 30 moves to reach the immovable portion 20; thus, an intimate contact between the heat pipe and the movable and immovable portions 30, 20 defining the channel 50 can be realized to thereby reduce heat resistance between the heat pipe and the movable and immovable portions 30, 20. Two temperature sensors 36 are inserted into the movable portion 30 from a top thereof to reach a position wherein detecting portions of the sensors 36 are located in the positioning groove 32 and capable of automatically contacting the heat pipe to detect temperature of the condensing section of the heat pipe.

The channel 50 as shown in the preferred embodiment has a circle cross section to receive the condensing section of the heat pipe having a corresponding circle cross section. Alternatively, the channel 50 can have a rectangular cross section when the condensing section of the heat pipe has a flat rectangular configuration. Further alternatively, the immovable and movable portion 20, 30 construct without channel, the heat pipe is directly sandwiched between a bottom face of the immovable portion 20 and a top face of the movable portion 30. The temperature sensors 26, 36 are directly attached to the bottom and top faces of the immovable and movable portions 20, 30.

Generally, in order to ensure the heat pipe in close contact with the movable and immovable portions 30, 20, a clamping member such as a screw is applied to retain the movable portion 30 together with the immovable portion 20. However, in order to meet demand of the test of the heat pipes and realize exact position of the immovable and movable portions 20, 30 in mass production of the heat pipe, in this case, instead of the conventional clamping member, a supporting member 10 is used to support and assemble the immovable and movable portions 20, 30. The immovable portion 20 is fixed on the supporting member 10. A driving device 40 is installed on the supporting member 10 to drive the movable portion 30 to make accurate linear movement relative to the immovable portion 20 along a vertical direction, thereby realizing the intimate contact between the heat pipe and the movable and immovable portions 30, 20; thus, heat resistance between the condensing section of the heat pipe and the movable and immovable portions 30, 20 can be controlled at a minimum level.

The supporting member 10 comprises a seat 12 which is an electromagnetic holding chuck, whereby the testing apparatus can be easily fixed at any desired position which is provided with a platform made of ferroalloy. A first plate 14 is secured on the seat 12; a second plate 16 hovers over the first plate 14; a plurality of supporting rods 15 interconnect the first and second plates 14, 16 for supporting the second plate 16 above the first plate 14. The seat 12, the first and second plates 14, 16 and the rods 15 construct a mainframe for assembling and positioning the immovable and movable portions 20, 30 therein. The first plate 14 has the immovable portion 20 fixed thereon. In order to prevent heat in the immovable portion 20 from spreading to the first plate 14, an insulating plate 28 is disposed between the immovable portion 20 and the first plate 14. The insulating plate 28 has an elongate slot 282 defined in a bottom face thereof, wherein the bottom face abuts the first plate 14, and two through holes 284 vertically extending therethrough and communicating with the slot 282. The through holes 284 and slot 282 are used for extension of wires 260 of the temperature sensors 26 to connect with a monitoring computer (not shown).

The driving device 40 in this preferred embodiment is a step motor, although it can be easily apprehended by those skilled in the art that the driving device 40 can also be a pneumatic cylinder or a hydraulic cylinder. The driving device 40 is installed on the second plate 16 of the supporting member 10. The driving device 40 is fixed to the second plate 16 above the movable portion 30. A shaft (not labeled) of the driving device 40 extends through the second plate 16 of the supporting member 10. The shaft has a threaded end (not shown) threadedly engaging with a bolt 42 secured to a board 34 of the movable portion 30. The board 34 is fastened to the movable portion 30. When the shaft rotates, the bolt 42 with the board 34 and the movable portion 30 is moved upwardly or downwardly. Two though apertures 342 are defined in the board 34 of the movable portion 30 for extension of wires 360 of the temperature sensors 36 to connect with the monitoring computer. In use, the driving device 40 drives the movable portion 30 to make accurate linear movement relative to the immovable portion 20, wherein, 1) the movable portion 30 is driven to depart a certain distance such as 5 millimeters from the immovable portion 20 to thereby facilitate the condensing section of the heat pipe which needs to be tested being inserted into the channel 50 or withdrawn from the channel 50 after the heat pipe has been tested; 2) the movable portion 30 is driven to move toward the immovable portion 20 to thereby realize an intimate contact between the condensing section of the heat pipe and the immovable and movable portions 20, 30 during which the test is performed. Accordingly, the requirement for the testing, i.e., veracity, facility and celerity can be realized by the testing apparatus in accordance with the present invention.

It can be understood, positions of the immovable portion 20 and the movable portion 30 can be exchanged, i.e., the movable portion 30 is located on the first plate 14 of the supporting member 10, and the immovable portion 20 is fixed to the second plate 16 of the supporting member 10, and the driving device 40 is positioned to be adjacent to the immovable portion 20. Alternatively, the driving device 40 can be installed to the immovable portion 20. In a further alternative, each of the immovable and movable portions 20, 30 has one driving device 40 installed thereon to move them toward/away from each other.

Figure 3A:
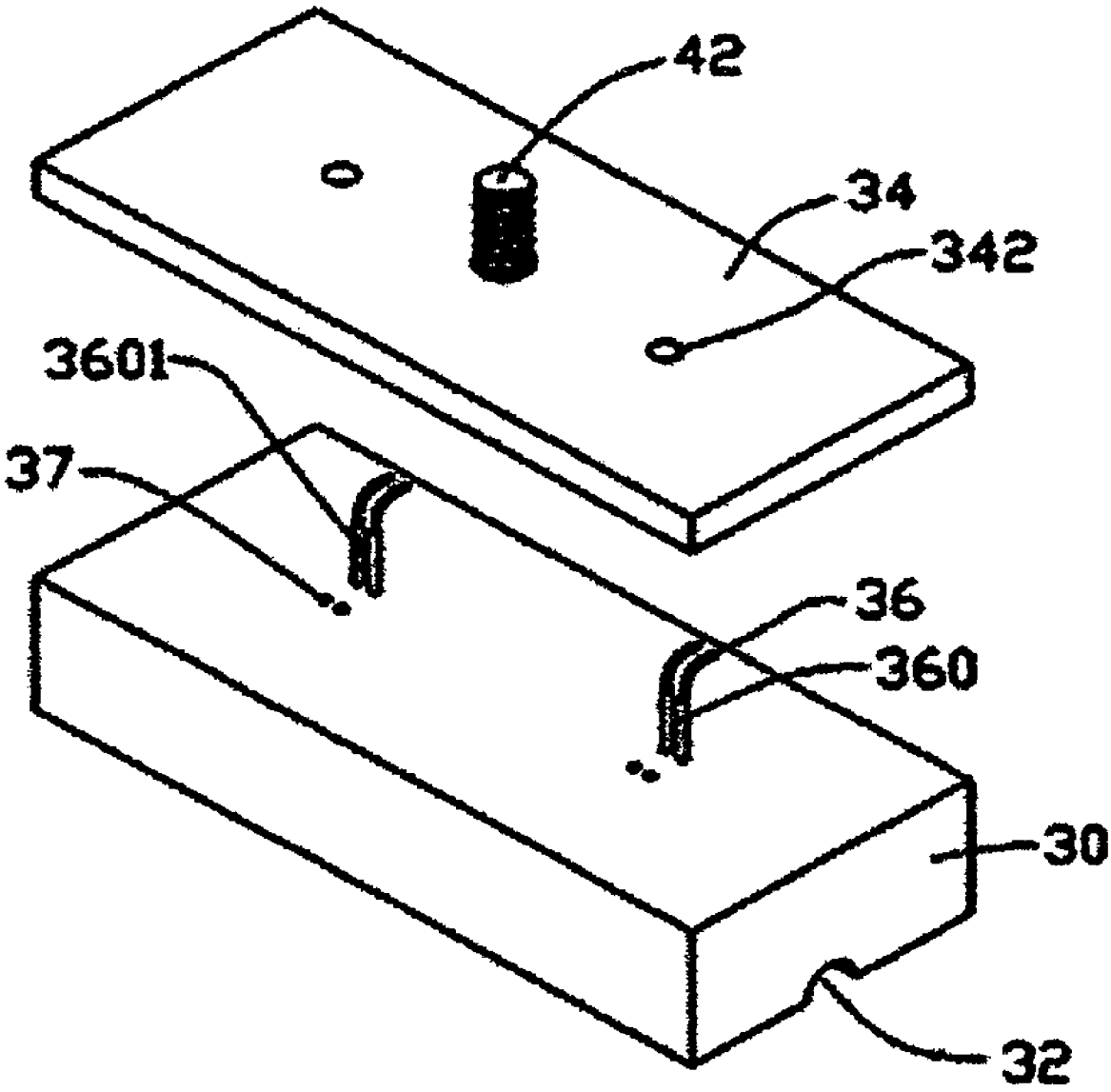
FIG. 3A shows a movable portion and two temperature sensors of the testing apparatus of FIG. 2.
Figure 3B:
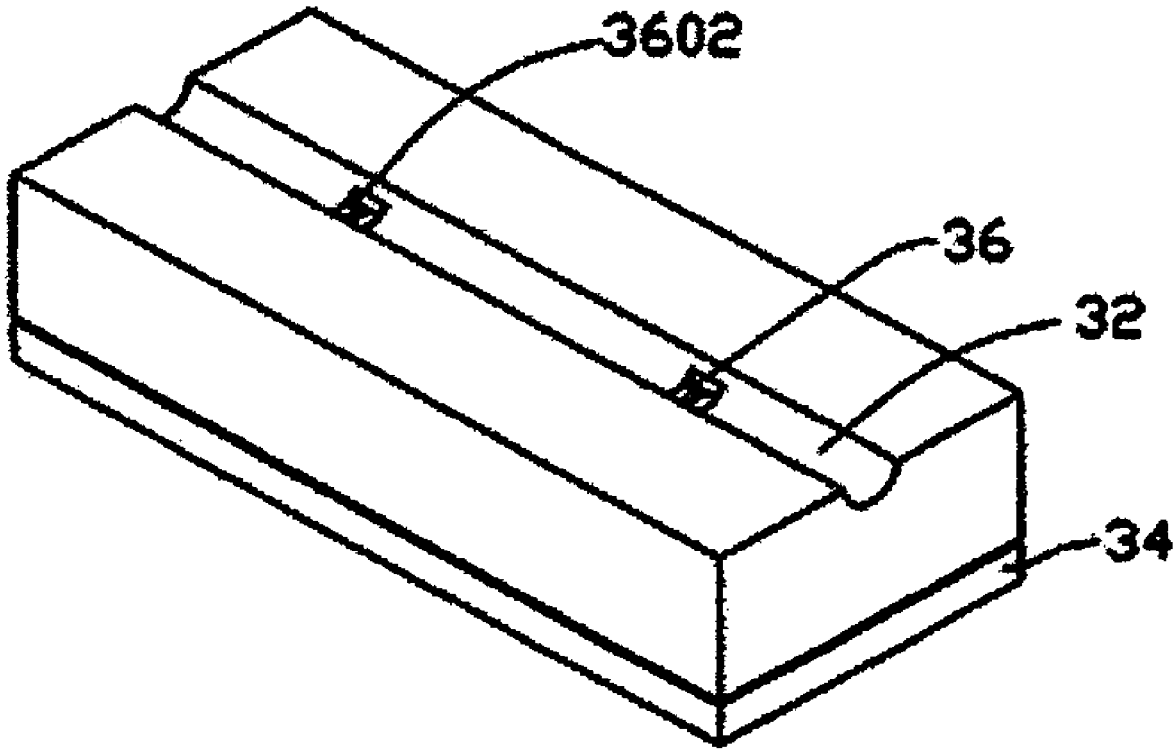
FIG. 3B is an assembled view of FIG. 3A.

Referring to FIGS. 3A and 3B, a movable portion 30 and two temperature sensors 36 in accordance with a first embodiment of the present invention are illustrated. In this case, the two sensors 36 which work independently are substantially vertically mounted in two different places of the movable portion 30. Each of the sensors 36 has two wires 360 inserted in two pairs of though apertures 37 vertically extending through the movable portion 30, wherein working (detecting) sections 3602 of the two wires 360 are located in the groove 32. Each of the two wires 360 has two vertical sections 3601 extending in a corresponding pair of the apertures 37 of the movable portion 30. The working section 3602 interconnects bottom ends of two corresponding vertical sections 3601. One the of vertical sections 3601 of each wire 360 has an upper extension extending through a corresponding aperture 342 in the board 34 to connect with the monitoring computer.

In use, the condensing section of the heat pipe is received in the channel 52 when the movable portion 30 is moved away from the immovable portion 20. Then the movable portion 30 is moved to reach the immovable portion 20 so that the condensing section of the heat pipe is tightly fitted in the channel 50. The sensors 26, 36 are in thermal connection with the condensing section of the heat pipe; therefore, the sensors 26, 36 work to accurately send detected temperatures of the condensing section of the heat pipe to the monitoring computer. Based on the temperatures obtained by the plurality of sensors 26, 36, an average temperature can be obtained by the monitoring computer very quickly; therefore, performance of the heat pipe can be very quickly decided.

In the embodiment, in order to help the condensing section of the heat pipe to have an intimate contact with the working sections 3602 of the sensors 36, each of the working sections 3602 is formed to have a curved configuration with a curvature corresponding to that of the condensing section of the heat pipe.

Figure 4A:
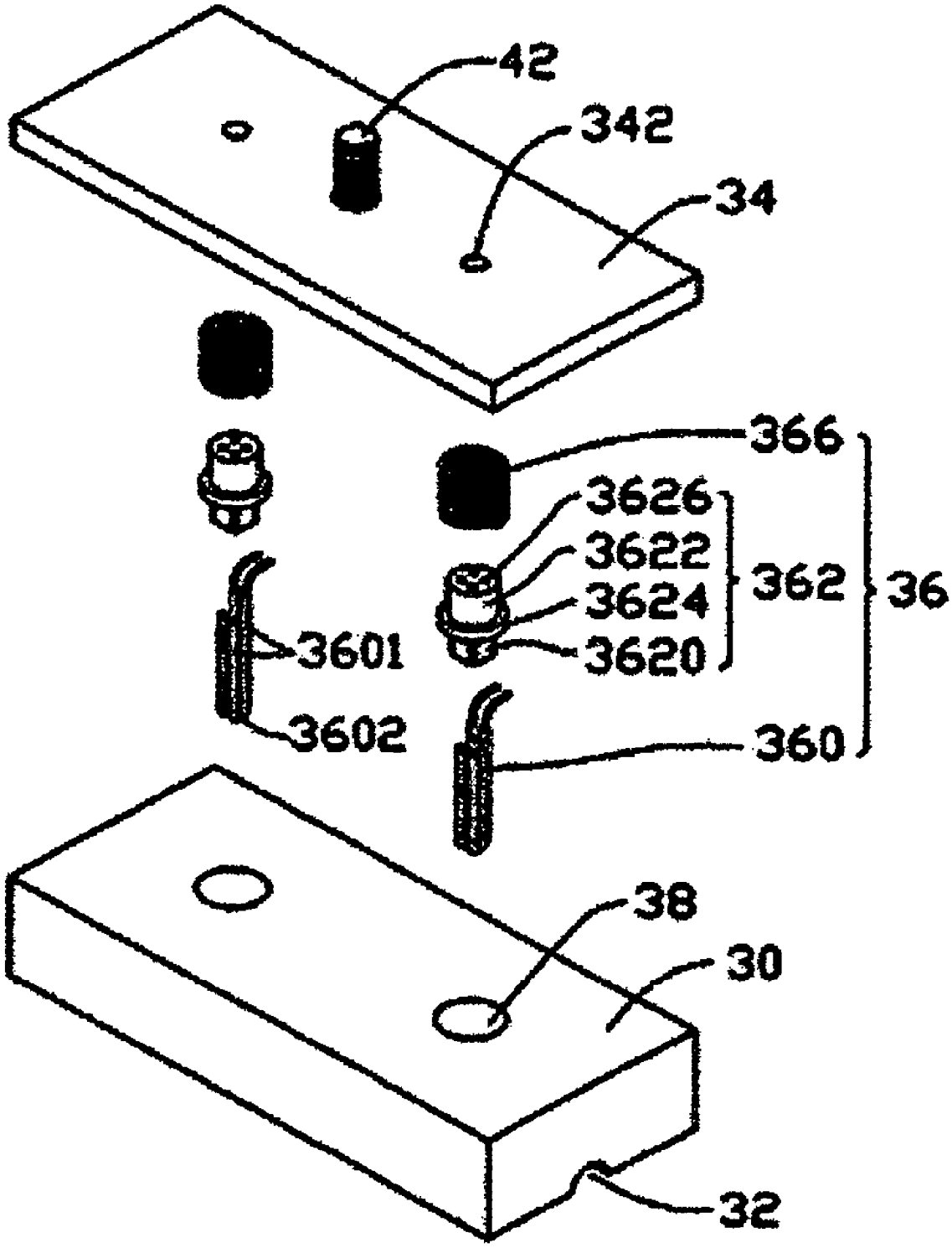
FIG. 4A shows a movable portion and two temperature sensors in accordance with a second embodiment of the present invention.
Figure 4B:
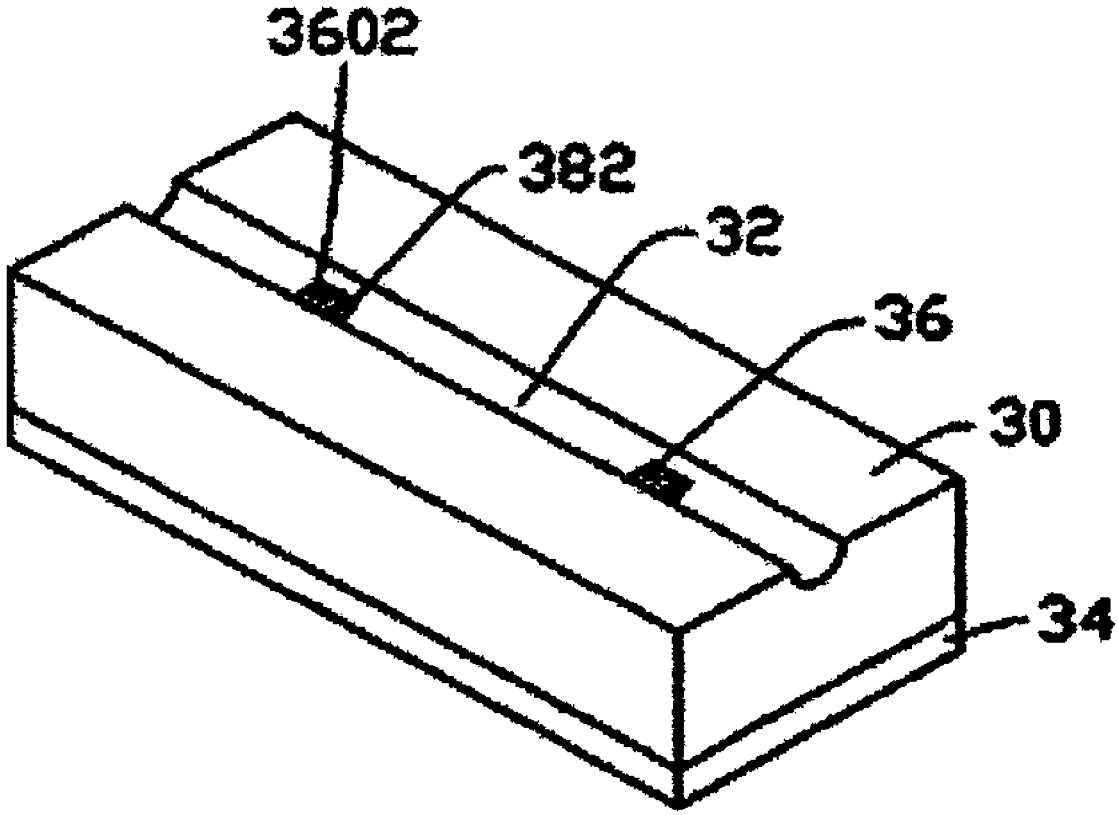
FIG. 4B is an assembled view of FIG. 4A.

Referring to FIGS. 4A and 4B, a movable portion 30 and two temperature sensors 36 in accordance with a second embodiment of the present invention are shown. What is main difference from the first embodiment is that the movable portion 30 has two through holes 38 substantially vertically extending therethrough, and two temperature sensors 36 are inserted in the two through holes 38, respectively. In this embodiment, the through holes 38 communicate with the positioning groove 32 in different positions of the movable portion 30. Each of the two temperature sensors 36 comprises a positioning socket 362 and a pair of thermocouple wires 360 fitted in the socket 362. The socket 362 comprises a square column 3620, a circular column 3622 above the square column 3620, and a circular collar 3624 between the square column 3620 and the circular column 3622. The socket 362 has two pairs of through apertures 3626 extending from a bottom of the square column 3620 to a top of the circular column 3622. A spring coil 366 circles around the circular column 3622 of the socket 362. Each wire 360 has two vertical sections 3601 extending in the apertures 3626 and a working section 3602 between the two vertical sections 3601 thereof. The working sections 3602 are located at the bottom of the square column 3620 and separated from each other. The vertical sections 3601 are secured in corresponding apertures 3626, respectively. The wires 360 extend upwardly from top ends of corresponding vertical sections 3601 through the apertures in 342 in the board 34 to connect with the monitoring computer. The through hole 38 has a portion 382 adjacent to the groove 32 being square to thereby ensure the square column 3620 fitted therein, and a round portion (not labeled) above the square portion 382 to ensure the collar 3624 and the spring coil 362 to be fitted therein. When the collar 3624 abuts against top of the portion 382, the circular column 3622 and a lower portion of spring coil 362 are received in the through hole 38. The board 34 is secured on the movable portion 30. The spring coil 366 is compressed between the board 34 and the movable portion 30. Here, the working sections 3602 of the wires 360 are pushed by the spring coil 366 to slightly extend in the groove 32. The use of the testing apparatus having the sensors 36 and movable portion 30 in accordance with the second embodiment is similar to that of the first embodiment.

In this embodiment, since the temperature sensors 36 are telescopically fitted in the through holes 38 and the working sections 3602 of the temperature sensors 36 are pushed by the spring coils 366 into the groove 32, a reliable intimate contact between the working sections 3602 and the condensing section of the heat pipe can be ensured.

Figure 5A:
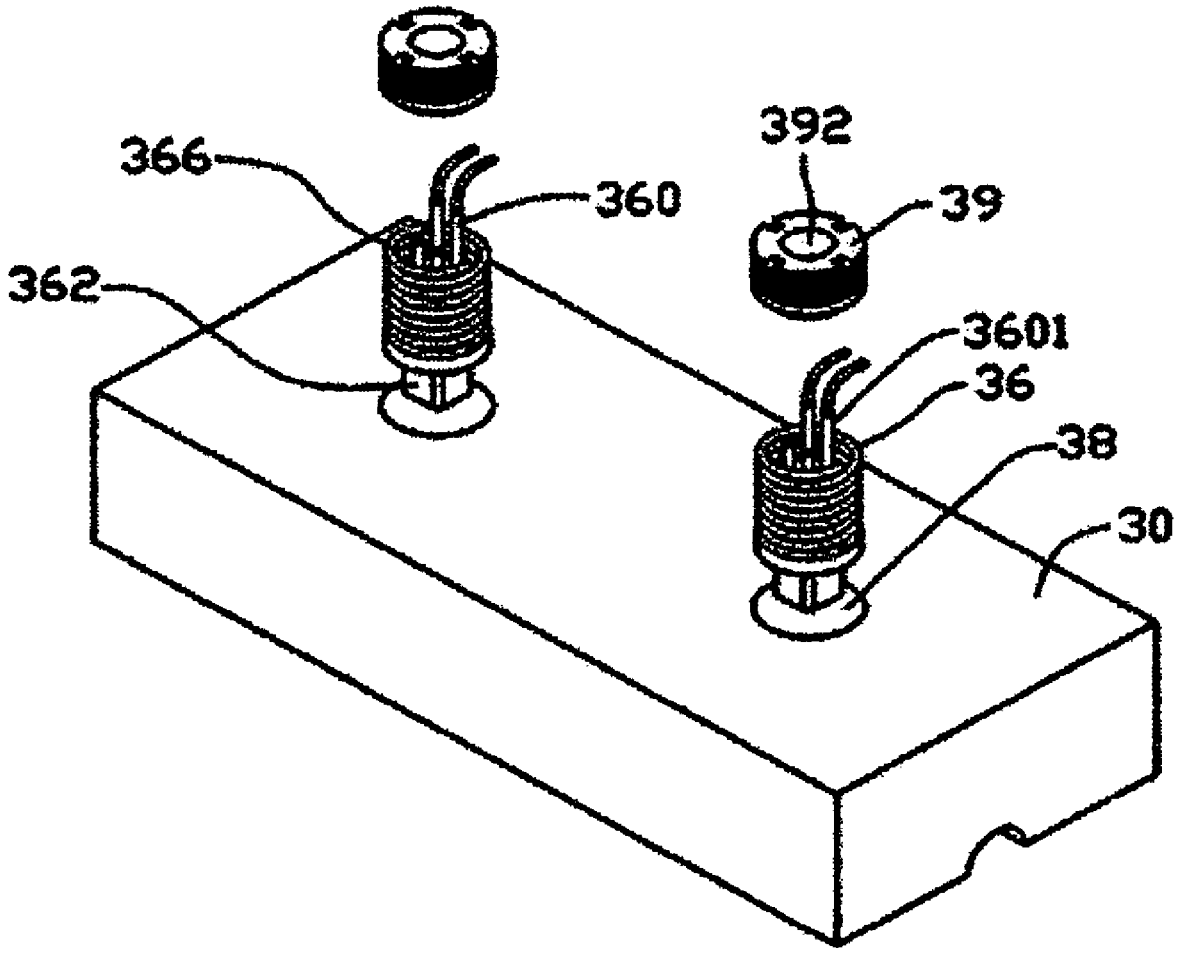
FIG. 5A shows a movable portion and two temperature sensors in accordance with a third embodiment of the present invention.
Figure 5B:
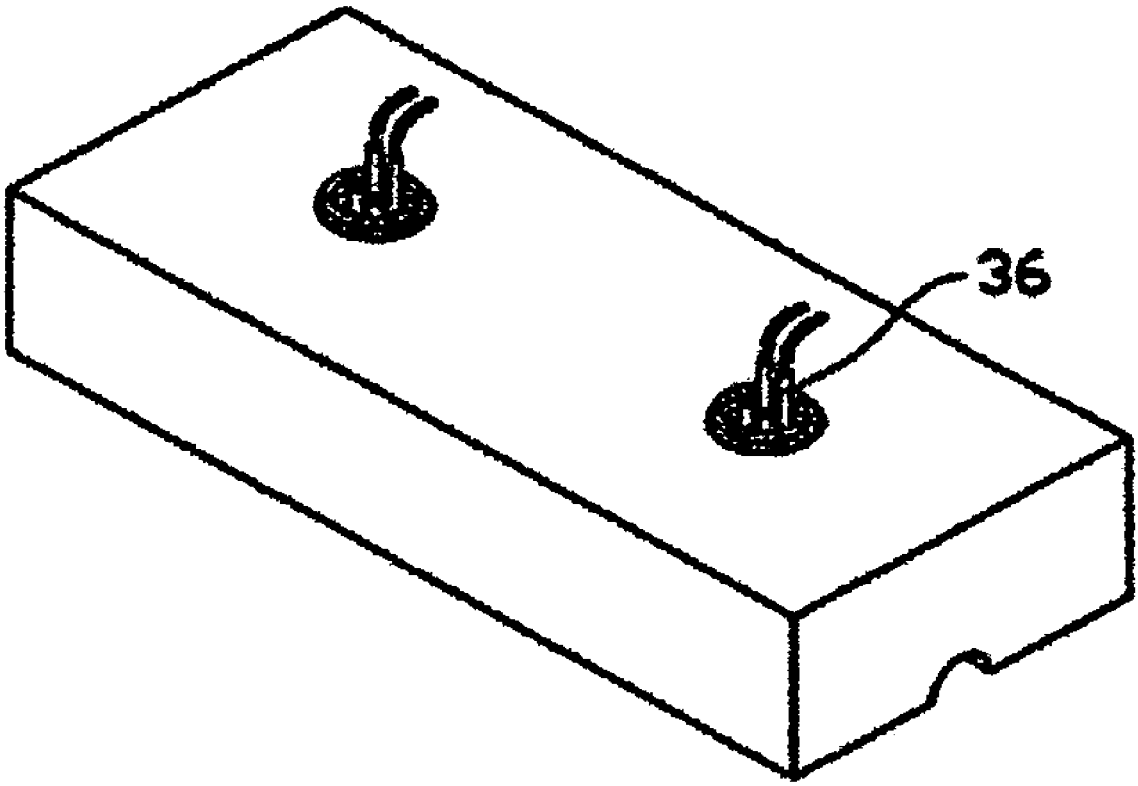
FIG. 5B is an assembled view of FIG. 5A.

Referring to FIGS. 5A and 5B, a movable portion 30 and two temperature sensors 36 in accordance with a third embodiment of the present invention are shown. The third embodiment is similar to the second embodiment, but what is main difference from the second embodiment is that the temperature sensor 36 has the spring coil 366 compressed by a screw 39 engaged in the hole 38 of the movable portion 30. The hole 38 has a thread (not shown) in an inner face thereof. The screw 39 has a thread in a periphery face thereof and a through opening 392 extending through a center thereof. The upper ends of the wires 360 extend through the opening 392 of the screw 39 to connect with the monitoring computer. The screw 39 is located upon a corresponding spring coil 366 and engaged in the hole 38, thereby compressing the spring coil 366 toward the groove 32 of the movable portion 30. By this design, the board 34 in the second embodiment can be omitted.

According to the third embodiment, the temperature sensor 36 is positioned on the hole 38 of the movable portion 30 via the screw 39 engaging in the hole 38. Therefore, 1) it is easy to install/remove the temperature sensor 36 to/from the movable portion 30; 2) it is easy to adjust the compression force of the spring coils to thereby provide suitable force on the working sections 3602 of the wires 360, whereby the working sections 3602 can have an optimal contact with the condensing section of heat pipe.

In the embodiments of the present invention, the wires 360 are perpendicular to the groove 32; apparently, they can be oriented with other angles in respective to the groove 32, so long as the wires 360 have an intimate contact with the condensing section of the heat pipe when the movable portion 30 moves toward the immovable portion 20.

Figure 6A:
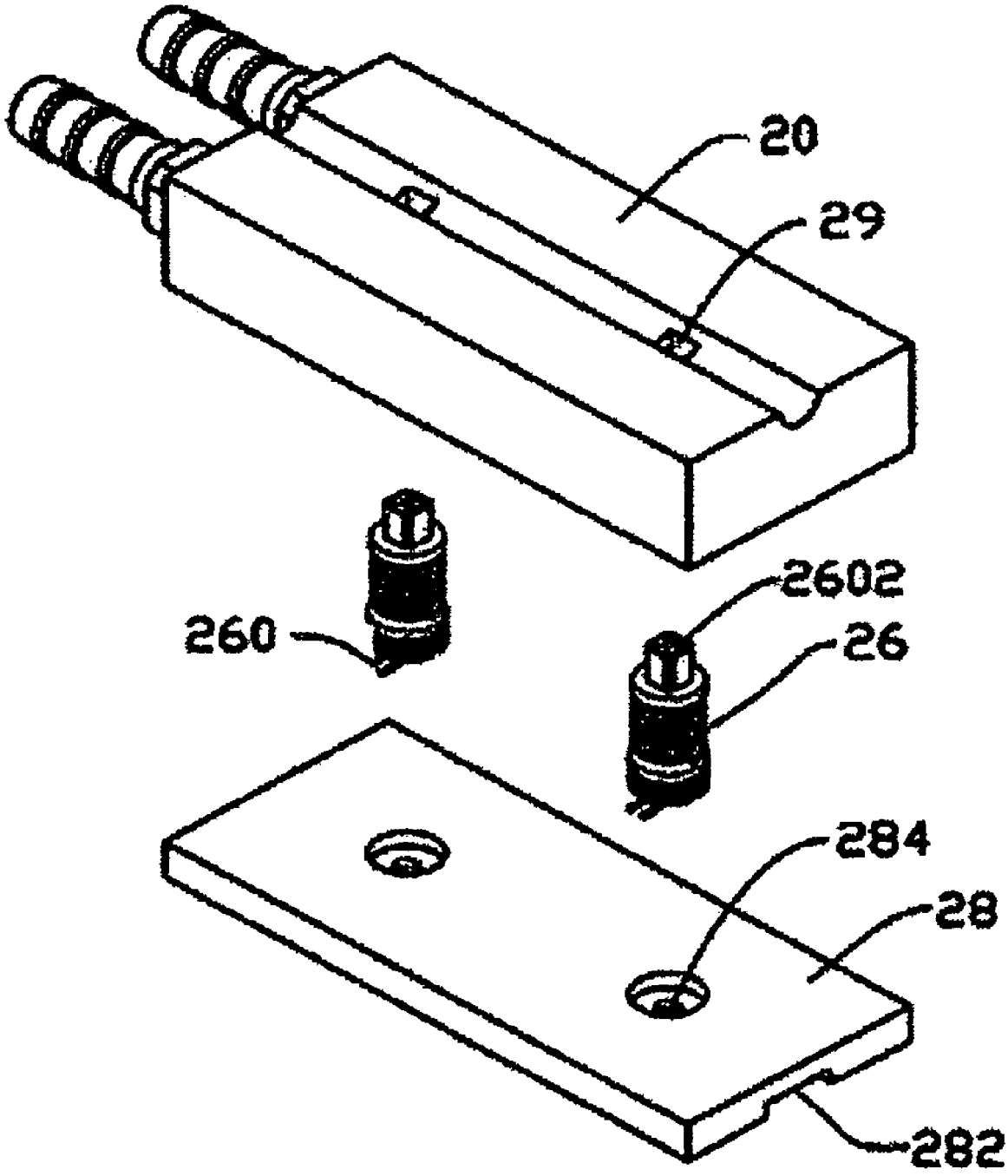
FIG. 6A shows an immovable portion and two temperature sensors of the testing apparatus of FIG. 2.
Figure 6B:
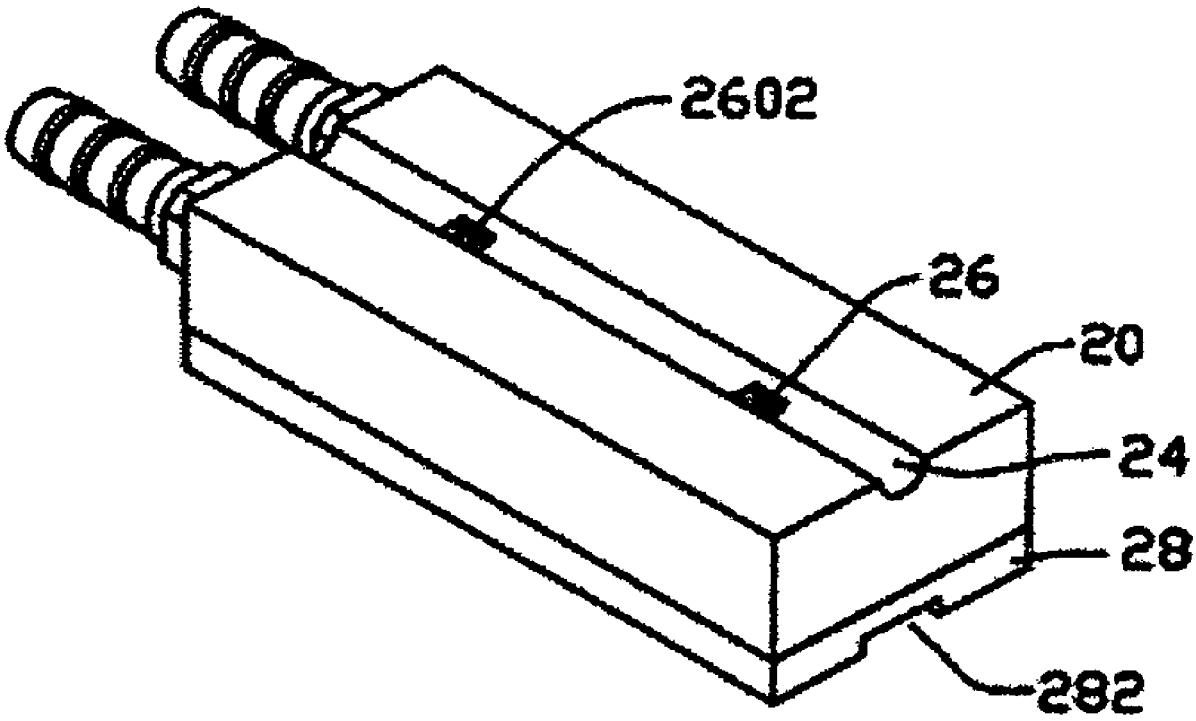
FIG. 6B is an assembled view of FIG. 6A.
Figure 7:
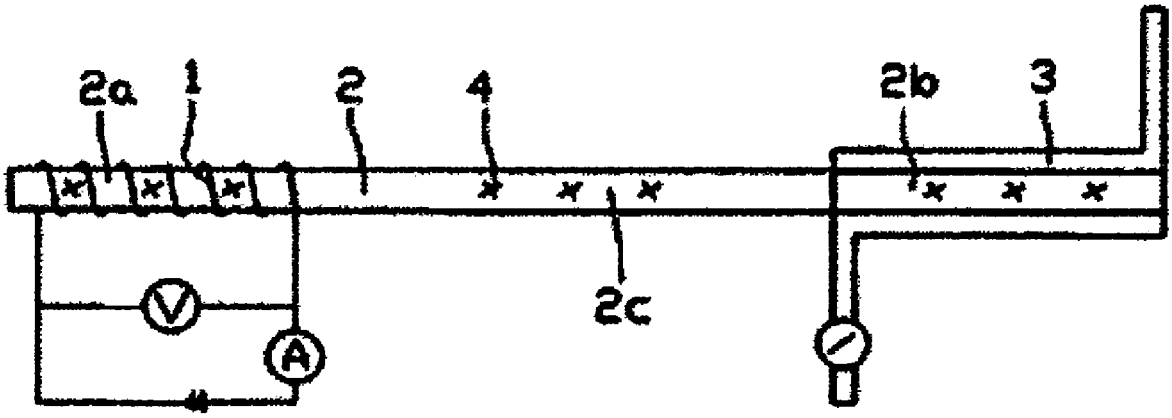
FIG. 7 (RELATED ART)
FIG. 7 is a conventional performance testing apparatus for heat pipes.

The temperature sensors 26 and the immovable portion 20 can have configuration and relationship similar to that of the temperature sensors 36 and the movable portion 30 as illustrated in the second and third embodiments. Referring to FIGS. 6A and 6B, the temperature sensors 26 are identical to the temperature sensors 36 of the third embodiment and each comprise two wires 260 each having a working section 2602 between two vertical sections (not labeled) thereof; a receiving hole 29 of the immovable portion 20 is identical to the hole 38 of the movable portion 30 in the second embodiment.

In the present invention, the movable portion 30 has the driving device 40 installed thereon to thereby drive the movable portion 30 to make accurate linear movement relative to the immovable portion 20; thus, the condensing section of the heat pipe needing to be tested can be accurately and fleetly positioned between the two portions 20, 30, and can intimately contact with the movable and immovable portions 30, 20, and therefore the heat in the heat pipe can be removed by the immovable portion 20 which has the coolant flowing therethrough. Furthermore, the temperature sensors 26, 36 are positioned in the holes of the immovable and movable portions 20, 30, and the temperature sensors 26, 36 intimately contact the condensing section of the heat pipe under an optimal conditional, after the movable portion 30 moves to reach the immovable portion 20. In comparison with the conventional testing apparatuses, the testing apparatus of the present invention can accurately, fleetly and facilely test the performance of the heat pipe. Therefore, the testing apparatus favors mass production of the heat pipes.

Furthermore, the apparatus has a plurality of temperature sensors synchronously detecting temperature of the condensing section of the heat pipe; therefore, an average temperature of the condensing section can be obtained to tell the performance of the heat pipe veraciously.

Additionally, in the present invention, in order to lower cost of the testing apparatus, the immovable portion 30, the insulating plate 28, the board 34, and the socket 362 can be made from low-cost material such as PE (Polyethylene), ABS (Acrylonitrile Butadiene Styrene), PF (Phenol-Formaldehyde), PTFE (Polytetrafluoroethylene) and so on. The immovable portion 20 can be made from Cu or Al. The immovable portion 20 can have Ag or Ni plated on an inner face in the groove 24 to prevent the inner face from being oxidized.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A performance testing apparatus for a heat pipe comprising:

an immovable portion having a cooling structure defined therein for cooling a heat pipe needing to be tested;

a movable portion capable of moving relative to the immovable portion;

a receiving structure being located between the immovable portion and the movable portion for receiving the heat pipe therein;

at least a temperature sensor being attached to at least one of the immovable portion and the movable portion for thermally contacting the heat pipe in the receiving structure for detecting temperature of the heat pipe;

wherein the receiving structure is a channel defined between the immovable portion and the movable portion;

wherein at least one of the immovable portion and the movable portion has at least a positioning structure communicating with the channel, the at least a temperature sensor being positioned in the at least a positioning structure;

wherein the at least a temperature sensor comprises two wires, each of the two wires comprising first and second sections and a working section between the first and second sections, the working section being the detecting portion of the at least a temperature sensor;

wherein the at least a temperature sensor is positioned in a positioning socket movably fitted in a through hole of the positioning structure of at least one of the immovable portion and the movable portion; and wherein the positioning socket defines four through apertures therethrough, and wherein each of the wires of the at least a temperature sensor has the first section thereof fitted in one of the through aperture, the second section fitted in another through aperture, and the working section located at a bottom of the socket for contacting to the heat pipe, and wherein an end of the second section extends away from the another through hole for connecting with a monitoring computer.

2. The testing apparatus of claim 1, wherein the positioning socket comprises a square column and a circular collar between the square and circular columns, and wherein the trough hole of the positioning structure has square and circular sections corresponding to the square column and the circular column of the socket, respectively.

3. The testing apparatus of claim 2, wherein the positioning socket has a spring coils circling around the circular column of the socket and movably received in the through hole of the positioning portion.

4. The testing apparatus of claim 3, wherein at least a temperature sensor is fixed in the through hole of the positioning structure via a board covering the positioning structure, and wherein the ends of the wires of the at least a temperature sensor extend through the board.

5. The testing apparatus of claim 3, wherein the at least a temperature sensor is secured in the through hole of the positioning structure via a screw engaged in the through hole, the ends of the wires of the at least a temperature sensor extending through the screw.

6. A performance testing apparatus for a heat pipe comprising;

an immovable portion having a cooling structure defined therein for cooling a heat pipe needing to be tested;

a movable portion capable of moving relative to the immovable portion;

a receiving structure being located between the immovable portion and the movable portion for receiving the heat pipe therein;

at least a temperature sensor being attached to at least one of the immovable portion and the movable portion for thermally contacting the heat pipe in the receiving structure for detecting temperature of the heat pipe;

wherein the receiving structure is a channel defined between the immovable portion and the movable portion;

wherein the at least a temperature sensor has a detecting portion thereof exposed to the channel;

wherein at least one of the immovable portion and the movable portion has at least a positioning structure communicating with the channel, the at least a temperature sensor being positioned in the at least a positioning structure;

wherein the at least a temperature sensor comprises two wires, each of the two wires comprising first and second sections and a working section between the first and second sections, the working section being the detecting portion of the at least a temperature sensor; and wherein the at least a positioning structure of one of the immovable portion and the movable portion comprises two pairs of through holes therein, and wherein each of the two wires has the first section thereof extending in one of the through holes, the second section fitted in another through hole, and the working section located at a bottom of the positioning structure for contacting to the heat pipe, and wherein an end of the second section extends away from the another through hole for connecting with a monitoring computer.

* * * * *